US011807497B2

(12) United States Patent
Husmann

(10) Patent No.: US 11,807,497 B2
(45) Date of Patent: Nov. 7, 2023

(54) ELEVATOR SYSTEM

(71) Applicant: Inventio AG, Hergiswil (CH)

(72) Inventor: Josef Husmann, Lucerne (CH)

(73) Assignee: INVENTIO AG, Hergiswil (CH)

( * ) Notice: Subject to any disclaimer, the term of this patent is extended or adjusted under 35 U.S.C. 154(b) by 195 days.

(21) Appl. No.: 17/310,001

(22) PCT Filed: Feb. 4, 2020

(86) PCT No.: PCT/EP2020/052726

§ 371 (c)(1),
(2) Date: Jul. 9, 2021

(87) PCT Pub. No.: WO2020/164966

PCT Pub. Date: Aug. 20, 2020

(65) Prior Publication Data

US 2022/0089410 A1 Mar. 24, 2022

(30) Foreign Application Priority Data

Feb. 12, 2019 (EP) ..... 19156583

(51) Int. Cl.

| | |
|---|---|
| ***B66B 9/00*** | (2006.01) |
| ***B66B 7/04*** | (2006.01) |
| ***B66B 7/08*** | (2006.01) |
| ***B66B 11/00*** | (2006.01) |

(52) U.S. Cl.

CPC ..... *B66B 9/00* (2013.01); *B66B 7/046* (2013.01); *B66B 7/08* (2013.01); *B66B 11/0095* (2013.01)

(58) Field of Classification Search

CPC ..... B66B 7/046; B66B 9/00; B66B 11/0095
See application file for complete search history.

(56) References Cited

U.S. PATENT DOCUMENTS

| | | | | |
|---|---|---|---|---|
| 3,517,775 | A | 6/1970 | Meyer | |
| 4,004,654 | A * | 1/1977 | Hamy | B66B 9/003 187/250 |

(Continued)

FOREIGN PATENT DOCUMENTS

| | | |
|---|---|---|
| EP | 1634842 A2 | 3/2006 |
| EP | 1693331 A1 | 8/2006 |
| EP | 2219985 B1 | 2/2013 |

*Primary Examiner* — Diem M Tran
(74) *Attorney, Agent, or Firm* — William J. Clements; Shumaker, Loop & Kendrick, LLP

(57) ABSTRACT

An elevator system includes an elevator car movable in an elevator shaft, a suspension means extending in the elevator shaft, a drive machine associated with the suspension means and a controllable coupling device arranged on the elevator car. The suspension means has a coupling element that the coupling device can be coupled to and uncoupled from, as a result of which a drive connection between the elevator car and the suspension means can be established and released. The elevator system has a guide system guiding the coupling element during a movement in the elevator shaft. The guide system has a guide that is stationary relative to the elevator shaft and a runner that is connected to the coupling element via a connection and is guided along the guide. The connection between the coupling element and the runner enables a relative movement between the runner and coupling element.

24 Claims, 4 Drawing Sheets

(56) References Cited

U.S. PATENT DOCUMENTS

| | | | | |
|---|---|---|---|---|
| 5,131,502 | A * | 7/1992 | Sermi | B66B 7/046 414/137.1 |
| 7,168,526 | B2 * | 1/2007 | De Sousa Marreiros Alves | B61B 13/00 187/245 |
| 9,248,994 | B2 * | 2/2016 | Grundmann | B66B 9/003 |
| 10,370,221 | B2 * | 8/2019 | Steinhauer | B66B 9/003 |
| 2016/0152446 | A1 | 6/2016 | Dudde et al. | |

* cited by examiner

ELEVATOR SYSTEM

FIELD

The invention relates to an elevator system having a controllable coupling device for selectively coupling an elevator car to a suspension means.

BACKGROUND

EP 2219985 B1 describes an elevator system comprising two elevator cars which can be moved in the vertical direction in an elevator shaft, a self-contained suspension means guided around a lower deflection roller and an upper deflection roller, a drive machine in the form of an electric motor that is associated with the suspension means and a controllable coupling device arranged on each elevator car. The suspension means has a plurality of coupling elements, which can be designed, for example, as holes or cams. A coupling device of an elevator car can be coupled to and uncoupled from a coupling element, as a result of which a drive connection between the relevant elevator car and the suspension means can be established and released. An elevator car coupled to a suspension means can thus be moved in the first elevator shaft by means of the suspension means which can be driven by the relevant drive machine.

The elevator cars are only moved in one direction in the aforementioned elevator shaft, i.e. only upward or only downward. In order to be able to implement a revolving operation of the elevator cars, the elevator system has a further elevator shaft. The elevator cars can be moved horizontally between the two elevator shafts by means of a transfer device. During operation of the elevator system, an elevator car is coupled to a suspension means at a lower or an upper end position via the coupling device of the elevator car and a coupling element and is moved upward or downward via the suspension means by the associated drive machine until it has reached the upper or lower end position. There the elevator car is uncoupled from the suspension means and is moved horizontally into the other elevator shaft by a transfer device in the elevator shaft for the other direction of movement.

The described coupling elements of the suspension means can be connected to an elevator car via a coupling device, as described above. These coupling elements are hereinafter referred to as connected coupling elements. As described above, the coupling elements can also not be coupled to an elevator car. These coupling elements are hereinafter referred to as free coupling elements.

During operation of the aforementioned elevator system, i.e. when one or more elevator cars are moved in the elevator shaft, both connected and free coupling elements are moved in the elevator shaft. Vibrations of the suspension means can occur when the elevator cars are moved. The connected coupling elements are prevented from vibrating by their coupling to an elevator car. Without suitable countermeasures, the free coupling elements would participate in the vibrations of the suspension means. This could lead to a free coupling element striking an elevator car when passing it, or to a free coupling element striking the elevator shaft. Such a striking could lead to an audible impact and could cause damage to the elevator car and/or the elevator shaft and/or the coupling element.

SUMMARY

By contrast, the problem addressed by the invention is in particular to propose an elevator system which makes comfortable and simultaneously reliable operation of the elevator system possible. This problem is solved according to the invention by an elevator system having the features described below.

The elevator system according to the invention has an elevator car which can be moved in an elevator shaft, a suspension means extending in the elevator shaft, a drive machine associated with the suspension means and a controllable coupling device arranged on the elevator car. The suspension means has a coupling element which the coupling device can be coupled to and uncoupled from, as a result of which a drive connection between the elevator car and the suspension means can be established and released. The coupled elevator car can be moved in the elevator shaft by means of the suspension means which can be driven by the drive machine.

According to the invention, the elevator system has a guide system for guiding the coupling element during a movement in the elevator shaft. The guide system has a guide which is stationary relative to the elevator shaft and a runner which is connected to the coupling element via a connection and is guided along the guide. The connection between the coupling element and the runner is designed such that a relative movement between the runner and the coupling element is possible. The aforementioned connection can thus also be referred to as a flexible connection.

The aforementioned guide system advantageously prevents a free coupling element from striking an elevator car and elevator shaft during a movement in the elevator shaft and thus makes particularly comfortable operation of the elevator system possible. Connected coupling elements are fixedly coupled to an elevator car and thus participate in all movements of the corresponding elevator car. When moving in the elevator shaft, elevator cars are usually guided along car guide rails which can be oriented relative to the guide of the coupling element. Nevertheless, a movement and/or tilting of the corresponding elevator car relative to the guide of the coupling element can occur. Such movements and/or tilting can be caused, for example, by an uneven load distribution within the car. The flexible connection, according to the invention, of the coupling element to the runner allows compensation of the described movement and/or tilting of the elevator car, and thus of the coupling element, relative to the guide of the guide system of the coupling element. Since the elevator car can exert large forces on the coupling element during the described movement and/or tilting due to the mass thereof, damage to the guide system of the coupling element could occur without the described compensation. For example, the runner and/or the guide could be damaged, which can lead to a failure of the elevator system. The flexible connection of the runner to the coupling element according to the invention prevents such damage to the guide system of the coupling element and thus failures of the elevator system. In addition to particularly comfortable operation of the elevator system, particularly reliable operation of the elevator system is thus also made possible.

A guide which is stationary relative to the elevator shaft is in this context to be understood to mean that the guide is not movable in the elevator shaft. The guide can be designed, for example, as a guide rail which is fixed, for example screwed, to a shaft wall of the elevator shaft. It is also possible for the guide to be formed by the shaft wall itself. For this purpose, the shaft wall can have a special guide surface, for example.

The runner can also be referred to as a trolley. The runner can, for example, have one or more guide rollers which roll on the guide and are thus guided thereby. It is also possible for the runner to have a sliding surface, on which the guide slides along and is thus guided thereby.

The aforementioned connection, via which the runner is connected to the coupling element, can be designed, for example, as an axle in the form of a pin, which is movable at least in one direction relative to the coupling element. The aforementioned relative movement between the runner and the coupling element in particular has at least one horizontal component. The relative movement is also in particular limited.

The elevator system in particular has more than one elevator car, i.e. two to eight elevator cars, for example, which are fundamentally identical and all have a coupling device. The elevator system in particular has more than one elevator shaft, especially two elevator shafts, between which the elevator cars can be moved by means of transfer devices. In particular, a transfer station is arranged at both ends of the elevator shafts, such that a revolving operation of the elevator cars is possible. For this purpose, the elevator cars are only moved from bottom to top in a first elevator shaft and only from top to bottom in a second elevator shaft. When the upper or lower end of the relevant elevator shaft is reached, the elevator cars are moved into the other elevator shaft by means of a transfer station.

The elevator shaft or the elevator shafts are arranged in or on a building and extend mainly in the vertical direction, such that the elevator cars are mainly moved vertically during a movement in the elevator shaft.

The suspension means is in particular self-contained, i.e. annular, for example. It can therefore also be referred to as endless. However, this does not necessarily mean that the suspension means is designed as a homogeneous ring or only consists of one piece. The suspension means is in particular guided around a lower deflection roller and an upper deflection roller, at least one deflection roller being used as a drive roller or traction sheave, via which the suspension means can be driven by the drive machine associated therewith. The deflection rollers in particular have an effective diameter of less than 100 mm. Such small effective diameters of a deflection roller being used as a traction sheave allow a gearless drive of the suspension means that requires little installation space. A tensioning device can in particular be arranged on the suspension means, by means of which tensioning device the necessary suspension means pretension is generated and deviations in the original length of the self-contained suspension means and operational plastic length changes in the suspension means are compensated. The required tensioning forces can be generated, for example, by means of tension weights, gas springs or metal springs.

The drive machine is in particular designed as an electric motor which is controlled by an elevator controller. The elevator controller controls the entire operation of the elevator system; it therefore controls all controllable components of the elevator system and is connected to switches and sensors of the elevator system. The elevator controller can be designed as a single central elevator controller or consist of a plurality of decentralized controllers which are responsible for subtasks.

The coupling devices arranged on the elevator car(s) are in particular arranged on a floor or a roof of the elevator cars and are controlled by the elevator controller mentioned above. The coupling to a coupling element of the suspension means in a coupled position of the coupling device in particular takes place in a form-fitting manner, with a frictional coupling also being conceivable. The coupling element in particular has a mainly horizontally oriented recess which an extendable and retractable bolt of the coupling device can enter in an actuation direction, for example. In this case, the coupling device is in the coupled position thereof when the bolt of the coupling device enters the recess of the coupling element, and in the uncoupled position thereof when the bolt does not enter the recess.

A form-fitting or frictional connection between the elevator car and the suspension means can thus be established by the coupling device and the coupling element, such that the elevator car is also moved when the drive means is displaced or moved. A drive connection between the elevator car and the suspension means and thus ultimately between the elevator car and the drive machine associated with the suspension means can thus be established and also released again. The coupling devices are in particular controlled such that only one elevator car is coupled to a (single) suspension means, at least during the movement of an elevator car. In particular, only one (single) elevator car is therefore always moved in the shaft by a (single) suspension means.

A coupling element of a suspension means is in particular designed as a connecting element which connects two free ends of the suspension means to one another. The use of a self-contained suspension means makes it possible to dispense with a counterweight which has to be guided past the elevator car, which allows the elevator shaft to have a small cross section. In addition, the coupling element designed in this way fulfills a double function. The coupling element is used to couple the elevator car to the suspension means and to implement the closed suspension means in a simple and cost-effective manner.

The coupling element in particular fulfills the function of what is referred to as a belt joint or a cable connector. A self-contained suspension means can thus be produced very simply, cost-effectively and reliably from an originally open, elongate suspension means by connecting the two free ends to the coupling element. The coupling element can, for example, have two interconnected suspension means end connections, which can be designed, for example, in accordance with EP 1634842 A2. The two suspension means end connections can be connected, for example, via an intermediate piece, to which they can be screwed or welded, for example. The coupling element can also have a single-piece housing.

In one embodiment of the invention, the guide of the guide system extends along a shaft wall of the elevator shaft. The aforementioned connection between the coupling element and the runner is designed such that a first relative movement between the runner and the coupling element is possible, which relative movement has at least one component in the direction of the aforementioned shaft wall and away from the shaft wall. Frequently occurring movements of the elevator car and thus of the coupling element in the direction of the shaft wall and away from the shaft wall can therefore advantageously be compensated. This makes particularly safe operation of the elevator system possible.

The aforementioned component of the direction in particular extends mainly perpendicularly to the shaft wall and thus mainly horizontally. The aforementioned relative movement extends in particular only toward the shaft wall and away from the shaft wall and thus in particular only perpendicularly to the shaft wall. However, the movement can also have a component which is oriented along the shaft wall, i.e. overall extends obliquely with respect to the shaft wall or along a circular path.

The guide is in particular designed as a guide rail which is fixed, for example screwed, to the shaft wall. The aforementioned direction of the component of the relative movement thus also extends in the direction of the guide rail and away from the guide rail. The statements regarding the orientation of the relative movement with respect to the shaft wall thus apply analogously to an orientation of the relative movement with respect to the guide rail. The relative movement also in particular extends in the actuation direction mentioned above, in which a bolt of the coupling device can be extended and retracted for coupling to a coupling element.

In this context, a shaft wall is to be understood to mean a boundary of the elevator shaft in the horizontal direction. A shaft wall is in particular designed as a solid wall, for example made of concrete. It is also possible, however, for a shaft wall to be formed merely from a plurality of cross members to which car guide rails can be fixed, for example. This can occur in particular when a plurality of elevator shafts are arranged next to one another and the individual elevator shafts are separated from one another by cross members.

In one embodiment of the invention, the connection between the coupling element and the runner has a pin which is coupled to the runner and is arranged in a recess in the coupling element so as to be movable in the direction of the shaft wall and away from the shaft wall. This makes a particularly simple and thus cost-effective flexible connection possible.

In order to couple the aforementioned pin to the runner, the pin can be fixed, for example screwed, on the runner. It is also possible for the runner to be designed as a guide roller which is rotatably arranged on the pin. In addition, the runner can also have a lever which is pivotably arranged on the pin.

In particular, it is not the entire pin, but rather only part of the pin, that is arranged in the aforementioned recess. The recess is in particular designed as a through-opening through which the pin projects. The pin is in particular secured against leaving the through-opening.

In one embodiment of the invention, the connection has a first spring arrangement which is designed and arranged such that it can apply a force to the runner in the direction of the first relative movement. Relative movements occurring between the runner and the coupling element can thus be cushioned in the direction of the first relative movement. This makes particularly smooth guidance of the runner possible.

The first spring arrangement in particular has a first spring which presses the runner away from the coupling element. An abutment of the runner against the coupling element, which could cause disturbing noises, can thus be prevented. The first spring arrangement also in particular has a second spring which pulls the runner toward the coupling element. Relative movements of the runner away from the coupling element can thus also be cushioned. In addition, a rest position of the runner can be set in the direction of the first relative movement by means of an appropriate design of the first and second springs, which rest position is assumed by the runner when no other forces are acting on it.

In one embodiment of the invention, the guide extends along a shaft wall of the elevator shaft. The connection between the coupling element and the runner is designed such that a second relative movement between the runner and the coupling element along the shaft wall is possible, which relative movement has at least one horizontal component. Allowing a second relative movement between the runner and the coupling element makes particularly comfortable and reliable operation of the elevator system possible.

The above statements regarding the guide, the guide rail and the shaft wall also apply to this embodiment of the invention.

The aforementioned relative movement can in particular extend horizontally and thus have only one horizontal component. The relative movement then extends mainly in parallel with the aforementioned shaft wall. However, the movement can also have a vertical component or extend along a circular path.

The connection between the coupling element and the runner is in particular designed such that a first relative movement between the runner and the coupling element, which first relative movement has at least one component in the direction of the shaft wall and away from the shaft wall, and, in addition, a second relative movement between the runner and the coupling element along the shaft wall, which second relative movement has at least one horizontal component, are possible. It is also possible, however, for only the first relative movement or the second relative movement to be possible.

In one embodiment of the invention, the guide guides the runner in the direction of the first relative movement and in the direction of the second relative movement between the runner and the coupling element. This makes particularly reliable guidance of the runner and thus of the coupling element possible. This leads to a particularly comfortable operation of the elevator system. Guiding the runner in the directions of the first and second relative movements is in this case to be understood to mean that the runner cannot be moved or can only be moved to a very limited extent with respect to the guide in the directions of the first and second relative movements. In the case of a vertically extending guide, the runner can thus also be moved mainly only vertically.

In one embodiment of the invention, the aforementioned recess, which at least partially receives the pin mentioned above, is arranged on a pivot arm of the coupling element that can be pivoted along the aforementioned shaft wall. The two described relative movements can thus be implemented in a particularly simple and cost-effective manner.

In one embodiment of the invention, the connection has a second spring arrangement which is designed and arranged such that it can apply a force to the runner in the direction of the second relative movement. Relative movements occurring between the runner and the coupling element can thus be cushioned in the direction of the second relative movement. This makes particularly smooth guidance of the runner possible.

The second spring arrangement in particular has a third spring and a fourth spring which act in opposition to one another. A rest position of the runner can be set in the direction of the second relative movement by means of an appropriate design of the third and fourth springs, which rest position is assumed by the runner when no other forces are acting on it.

In one embodiment of the invention, the guide has a side cheek and the runner has a guide roller, the guide roller being guided on an inner face of the side cheek of the guide. This makes a simple implementation of the guide possible.

In this context, a side cheek should be understood to mean a portion of the guide that projects away from the shaft wall into the elevator shaft.

In one embodiment of the invention, the guide in particular has a first side cheek and an opposite second side cheek and the runner has a first guide roller and a second guide roller. The first guide roller is guided on the inner face of the first side cheek of the guide and the second guide roller is guided on the inner face of the second side cheek of the guide. The guidance by means of two guide rollers makes particularly good guidance of the coupling element and thus particularly comfortable operation of the elevator system possible.

In one embodiment of the invention, the first guide roller is mounted on a first roller axle and the second guide roller on a second roller axle. The two roller axles are arranged on a lever of the runner that is pivotable about a lever axle, the two roller axles in particular being arranged on opposite sides of the lever with respect to the lever axle. Thus, by pivoting the aforementioned lever, the two guide rollers can be pivoted in the direction of the side cheeks of the guide or pivoted away from the side cheeks.

In one embodiment of the invention, the lever axle of the pivotable lever of the runner is at least partially formed by the above-described pin of the connection between the coupling element and the runner. The pin thus has a double function, which makes a simple and cost-effective implementation of the connection of the runner to the coupling element possible.

In one embodiment of the invention, the runner has a third spring arrangement which is designed and arranged such that the guide rollers are pressed against the inner faces of the side cheeks of the guide. This ensures that the guide rollers always roll on the side cheeks of the guide and cannot become detached therefrom. This makes particularly good guidance of the coupling element and thus particularly comfortable operation of the elevator system possible.

The third spring arrangement has a fifth spring and, in particular, additionally has a sixth spring, which springs are in particular tensioned between the lever of the runner and the coupling element such that they press the guide rollers against the inner faces of the side cheeks of the guide. If a sixth spring is provided, it acts in the same direction as the fifth spring.

In one embodiment of the invention, the inner faces of the side cheeks of the guide have a concave contour and the guide rollers of the runner have a corresponding convex profile. This ensures the largest possible area of contact between the guide rollers and the guide, which makes particularly good guidance of the coupling element and thus particularly comfortable operation of the elevator system possible. In addition, due to their concave contour, the side cheeks allow simultaneous guidance in the aforementioned first direction and the aforementioned second direction of the relative movement between the runner and the coupling element. In this way, very precise guidance of the coupling element and thus particularly comfortable operation of the elevator system can be made possible in a simple and cost-effective manner.

Further advantages, features and details of the invention can be found in the following description of embodiments and with reference to the drawings, in which like or functionally like elements are provided with identical reference signs. The drawings are merely schematic and are not to scale.

DETAILED DESCRIPTION

Figure 1:
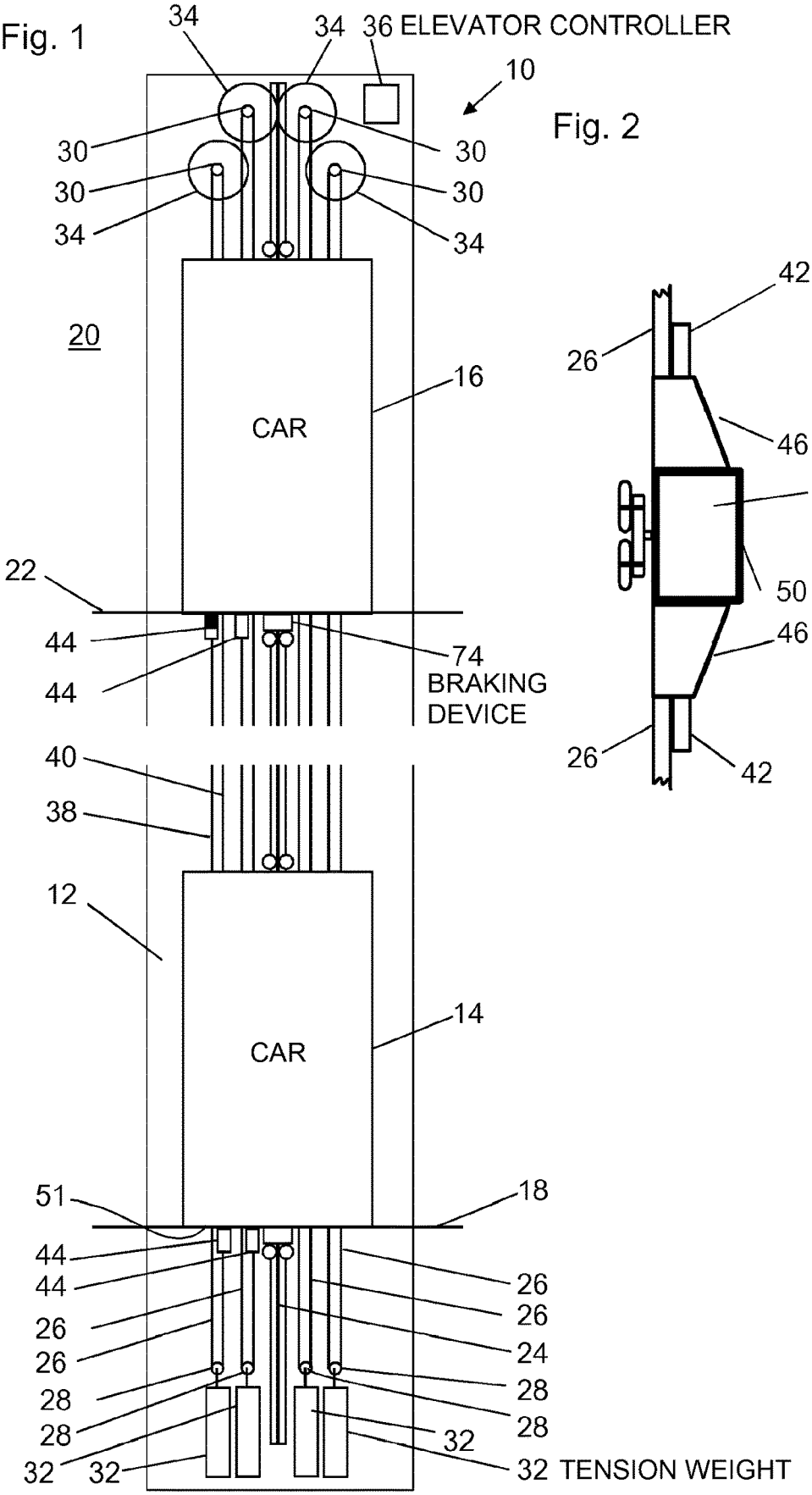
FIG. 1 shows a first elevator shaft of an elevator system comprising a first elevator car and a second elevator car.

According to FIG. 1, an elevator system 10 has a first elevator shaft 12 in which a first elevator car 14 and a second elevator car 16 are arranged. The first elevator car 14 is located at a lower end position 18 which corresponds to a position of the elevator car 14 at a lowermost floor of the building 20 having the elevator system 10. The second elevator car 16 is located at an upper end position 22 which corresponds to a position of the elevator car 16 at an uppermost floor of the building 20. Between the lower end position 18 and the upper end position 22 there are a plurality of floors which are not shown in FIG. 1.

The elevator system 10 has a car guide rail 24 extending in the vertical direction, on which the elevator cars 14, 16 are guided during a movement in the elevator shaft 12. In order to move the elevator cars 14, 16 in the elevator shaft 12, the elevator system 10 has a total of eight self-contained suspension means 26, of which four suspension means 26 are shown in FIG. 1. The suspension means 26 are designed as belts and are each guided around a lower deflection roller 28 and an upper deflection roller 30.

The two deflection rollers 28, 30 of a suspension means 26 are arranged vertically above one another such that the suspension means 26 extend vertically between the deflection rollers 28, 30. The deflection rollers 28, 30 in particular have an effective diameter of less than 100 mm. The lower deflection rollers 28 are arranged below the first elevator car 14 and are each connected to a tension weight 32. The tension weight 32 acts as a tensioning device, by means of which the necessary suspension means pretension is generated and deviations in the original length of the self-contained suspension means 26 and operational plastic length changes in the suspension means 26 are compensated.

The upper deflection rollers 30 are arranged above the second elevator car 16 and each acts as a traction sheave for a drive machine 34 designed as an electric motor. Each suspension means 26 is associated with a drive machine 34, by means of which the suspension means 26 can be driven and moved. The drive machines 34 are controlled by a control device in the form of an elevator controller 36, which controls all of the actuators of the elevator system 10.

Figure 2:
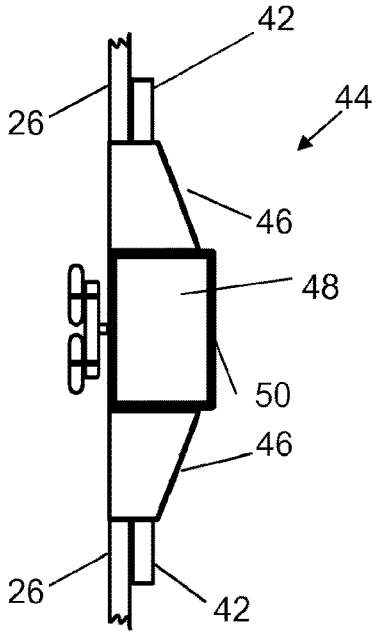
FIG. 2 is an enlarged view of a coupling element of a suspension means from FIG. 1 together with a runner of a guide system.

Each suspension means 26 consists of two suspension means parts 38, 40, the free ends 42 of which are connected by means of two coupling elements 44 which are shown in an enlarged view in FIG. 2. The coupling element 44 consists of two suspension means end connections 46 which are oriented in opposite directions and are connected to a connecting element 50 having a recess 48. The suspension means end connections 46 can be designed, for example, in accordance with the suspension means end connections described in EP 1634842 A2. An extendable bolt 60 (FIG. 4) of a coupling device 58 arranged on an elevator car 14, 16 can enter the recess 48, as a result of which the coupling device 58 couples to the coupling element 44. The coupling device 58 can be uncoupled from the coupling element 44 by pulling the bolt 60 out of the recess 48. The coupling devices 58 are arranged on a floor 51 of the elevator cars 14, 16 and are described in more detail in connection with FIG. 4. A coupling element 44 to which a coupling device 58 has been coupled has a filled square in the drawings. In FIG. 1, the second elevator car 16 is thus connected via a coupling element 44 to the suspension means 26 arranged on the far left in FIG. 1.

It is also possible for the coupling devices to be arranged on the roof of an elevator car. The positions of the coupling elements on the suspension means then have to be adapted accordingly.

As soon as an elevator car 14, 16 is coupled to a coupling element 44 via a coupling device 58 associated with the elevator car, a drive connection is established between the elevator car 14, 16 and the suspension means 26. In this coupled state, the elevator car 14, 16 is entrained by the suspension means 26 and is thus moved in the elevator shaft 12 when the suspension means 26 is driven or moved by the drive machine 34 associated therewith. In the state shown in FIG. 1, the second elevator car 16 can thus be moved in the elevator shaft 12. Since the first elevator car 14 in FIG. 1 is not coupled to any suspension means 26, a movement of the first elevator car 14 in the elevator shaft 12 is not possible in the state of FIG. 1.

The elevator cars 14, 16 each have a braking device 74, by means of which the elevator cars can be fixed to the car guide rail 24 and thus within the elevator shaft 12.

Figure 3:
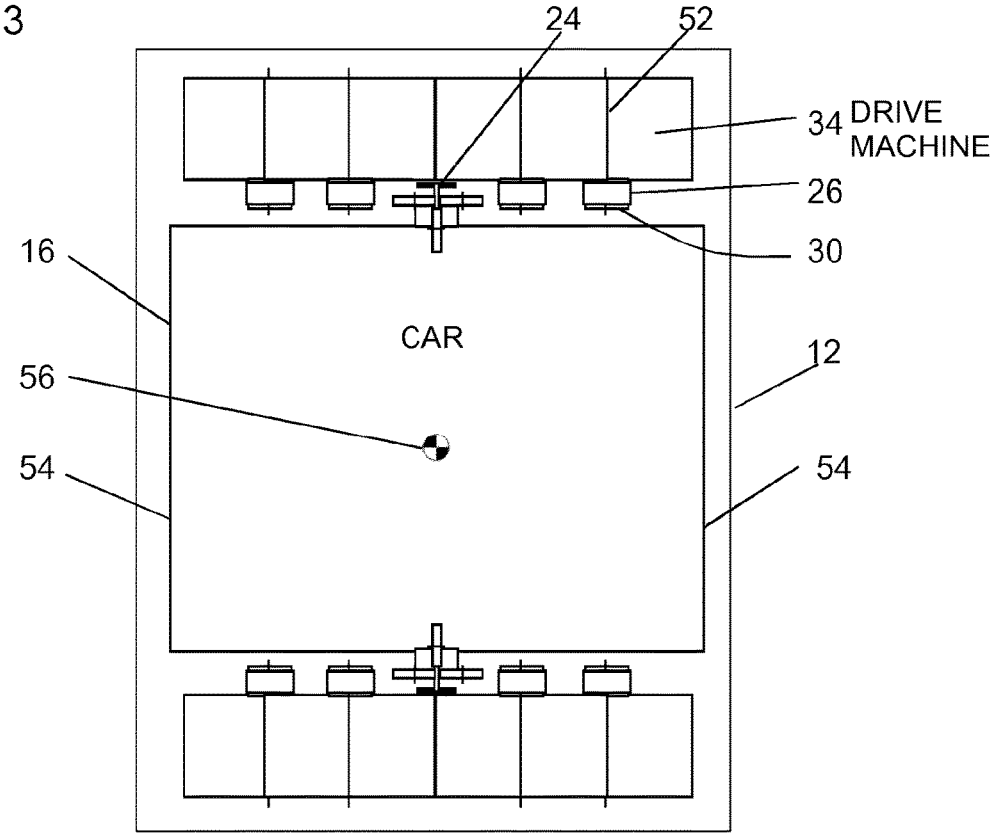
FIG. 3 is a view from above of the first elevator shaft having a total of eight drive machines.

FIG. 3 is a view from above of the first elevator shaft 12 having a total of eight drive machines 34. The drive machines 34 are each drive-connected to a traction sheave in the form of a deflection roller 30, over which a suspension means 26 extends. For reasons of clarity, the reference signs are shown only once in FIG. 3. Four drive machines 34 are arranged on opposite sides of the elevator car 16 in each case, two drive machines 34 being arranged on each of the opposite sides of the elevator car 16 on different sides of the extending car guide rail 24. Drive axles 52 of the drive machines 34 extend in parallel with one another, a drive machine 34 in each case being arranged coaxially on one side of the elevator car 16 with respect to a drive machine 34 on the other side of the elevator car 16. A car door (not shown) of the elevator car 16 is located on one or both free sides 54 of the elevator car 16, on which no drive machines 34 are arranged.

The elevator controller 36 (see FIG. 1) always controls two drive machines 34 on opposite sides in the same manner or synchronously, such that the suspension means 26 associated with the drive machines also move or are displaced synchronously. Two drive machines 34 which are arranged diagonally with respect to a center of gravity 56 of the elevator car, i.e. the upper drive machine 34 on the far left-hand side and the lower drive machine 34 on the far right-hand side in FIG. 3, for example, are always controlled in the same manner. Thus, by means of the eight drive machines 34, a total of four elevator cars 14, 16 can be moved simultaneously and independently of one another in the first elevator shaft 12.

Figure 4:
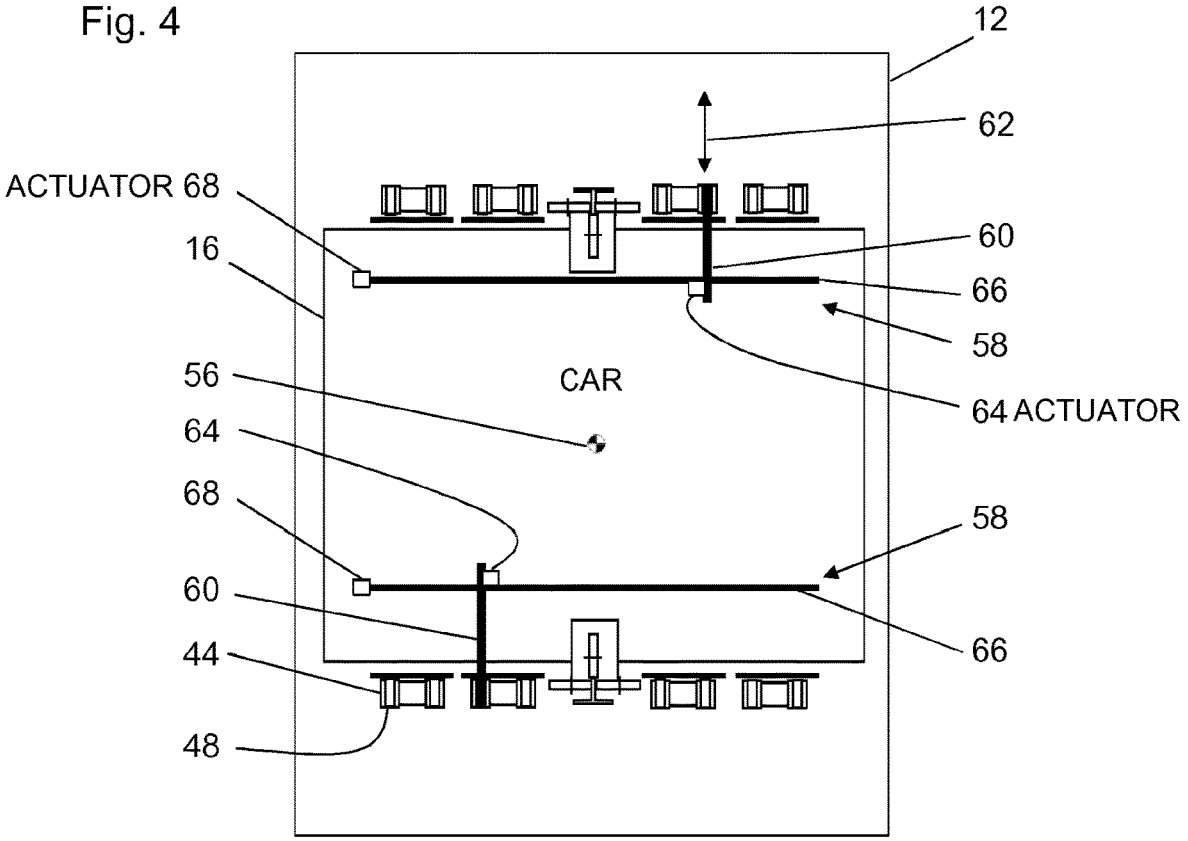
FIG. 4 is a view from below of an elevator car having two coupling devices for coupling to coupling elements of the suspension means.

FIG. 4 is a view from below of the elevator car 16 having two coupling devices 58 for coupling to coupling elements 44 of the suspension means 26. The coupling devices 58 are each arranged opposite the drive machines 34 (not shown in FIG. 4) and thus opposite the coupling elements 44 of the suspension means 26. Each coupling device 58 has a bolt 60 which can be extended and retracted in an actuation direction 62 which is oriented in the direction of the coupling elements 44. In order to extend and retract the bolt 60, the coupling device 58 has an operating actuator 64, which can be designed, for example, as an electric motor. In order to position the bolt 60 relative to the coupling elements 44, the bolt 60, together with the operating actuator 64, can be moved horizontally and perpendicularly relative to the actuation direction 62 along a rail 66 by means of a positioning actuator 68 which is also designed as an electric motor, for example.

In order to couple a coupling device 58 and thus the elevator car 16 to a coupling element 44 and thus to a suspension means 26, the bolt 60 is first correctly positioned with respect to the corresponding coupling element 44. The bolt 60 is then extended, as a result of which the bolt 60 enters the recess 48 of the coupling element 44. A form-fitting connection is thus established between the coupling device 58 and the coupling element 44, and thus between the elevator car 16 and the suspension means 26. When this form-fitting connection is established, the elevator car 16 can be moved in the elevator shaft 12.

As already described in connection with FIG. 3, the elevator car 16 is always coupled to two suspension means 26 which are arranged diagonally with respect to the center of gravity 56 of the elevator car. This is achieved by the elevator car 16 always being coupled to coupling elements 44 which are arranged diagonally with respect to the center of gravity 56 of the elevator car 16.

It is also possible for the bolts of the coupling devices to not be movable. In this case, the coupling devices have separate bolts for each coupling element, or a coupling device is associated with exactly one coupling element and thus exactly one suspension means.

The drive machines and thus the suspension means can also be arranged on a side of the elevator cars that is opposite the car door and thus the shaft doors. In this case, an elevator car in particular has only one coupling device, such that an elevator car is only coupled to one suspension means for movement in the elevator shaft.

In addition to a first elevator shaft 12, the elevator system 10 has a second elevator shaft (not shown) which is arranged parallel to the first elevator shaft 12. The second elevator shaft is designed analogously to the first elevator shaft 12. The movement of the elevator cars 14, 16 in the second elevator shaft is implemented analogously to the movement in the first elevator shaft 12. In the first elevator shaft 12, the elevator cars 14, 16 are only moved upward and in the second elevator shaft only downward.

In order to be able to implement a revolving operation of the elevator cars in the two elevator shafts, the elevator system 10 has two transfer devices (not shown), by means of which the elevator cars 14, 16 can be moved from the first elevator shaft to the second elevator shaft or from the second elevator shaft to the first elevator shaft. The transfer devices can in particular be designed in accordance with the transfer devices in the form of horizontal displacement units from EP 2219985 B1.

During the movement in the elevator shaft 12, a coupling element 44 is guided by a guide system 80, which is explained in connection with FIGS. 5-7.

Figure 5:
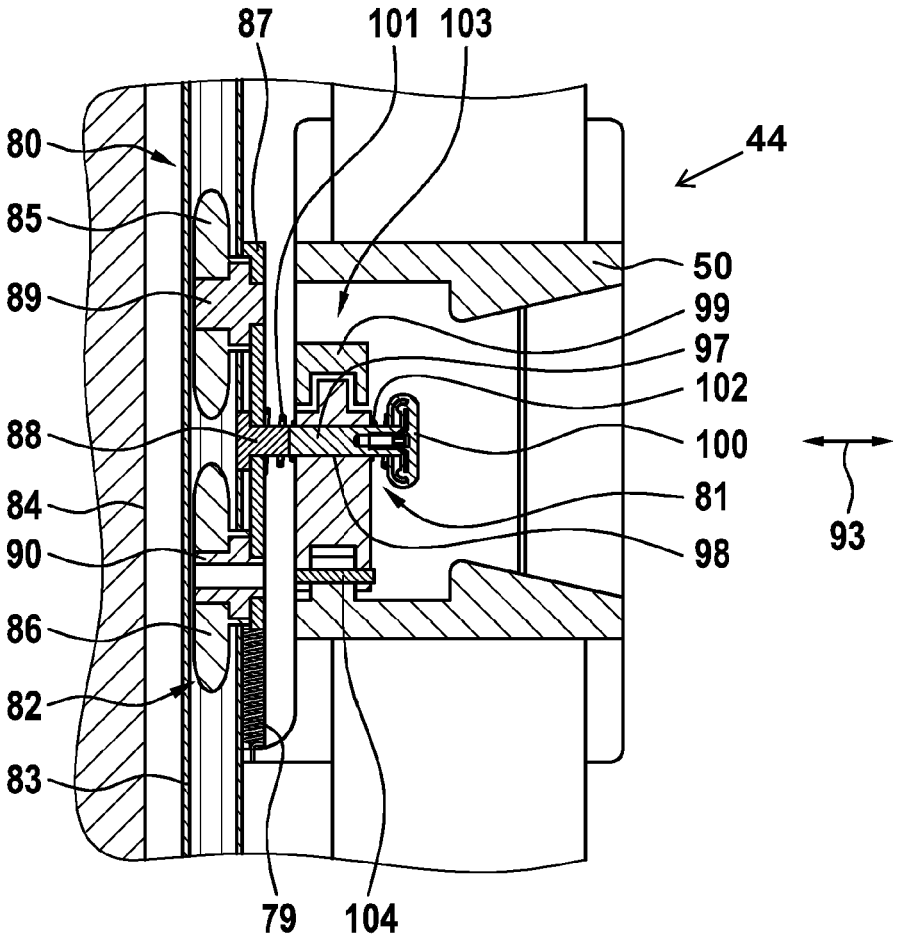
FIG. 5 shows a section through a coupling element including a guide system.
Figure 6:
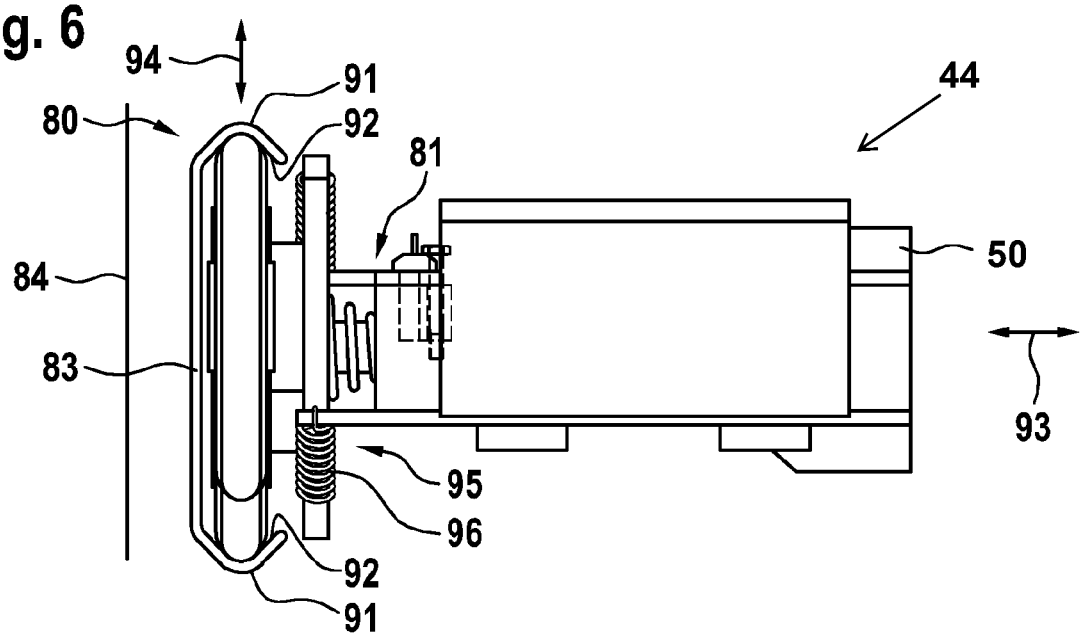
FIG. 6 is a view from above of the coupling element including the guide system from FIG. 5.

According to FIGS. 5 and 6, a coupling element 44 is connected to a runner 82 of the guide 80 via a connection 81. The runner 82 is guided in a guide in the form of what is referred to as a C-rail 83. The C-rail 83 is screwed and is thus fixed to a shaft wall 84 of the elevator shaft 12 (not shown in FIG. 5). The C-rail thus extends along the shaft wall 84 and is stationary relative to the elevator shaft 12. The runner 82 has a first, upper guide roller 85 and a second, lower guide roller 86 which are arranged on a lever 87 which is pivotable about a lever axle 88. For this purpose, the first guide roller 85 is mounted on a first roller axle 89 and the second guide roller 86 is mounted on a second roller axle 90. The two roller axles 89, 90 are in this case arranged on opposite sides of the lever 87 with respect to the lever axle 88.

As can be seen in FIG. 6, the C-rail 83 has two opposite side cheeks 91 which protrude from the shaft wall 84 into the elevator shaft 12. The inner faces 92 of the side cheeks 91 have a concave contour. The two guide rollers 85, 86 of the runner 82 have a corresponding convex profile on their outer circumference, such that the guide rollers 85, 86 are guided by the C-rail 83 in a first direction 93 toward and away from the shaft wall 84, and in a second direction 94 horizontally transversely to or along the shaft wall 84.

The runner 82 has a third spring arrangement 95 having an upper, fifth spring 96 (only visible in FIG. 6) and a lower, sixth spring 79 (only visible in FIG. 5). The springs 96, 79 are tensioned between the lever 87 and the coupling element 44 such that the guide rollers 85, 86 are pressed against the inner faces 92 of the side cheeks 91 of the C-rail 83. The spring arrangement 95 is shown more clearly in FIG. 7.

The connection 81, via which the runner 82 is connected to the coupling element 44, has a pin 97 which also forms the lever axle 88 of the pivotable lever 87 of the runner 82. A part of the pin 97 that is opposite the runner 82 projects through a recess in the form of a through-opening 98 through a pivot arm 99 of the coupling element 44. The pin 97 is in this case secured by a cap 100 screwed onto the end of the pin 97 that is opposite the runner 82. The pin 97 can be moved to a limited extent in the recess 98 in the direction of the shaft wall 84 and away from the shaft wall 84. The pin can therefore be moved in the first direction 93 mentioned above. This makes a first relative movement between the runner 82 and the coupling element 44 in the first direction 93 possible.

A first spring 101 in the form of a helical spring is arranged around the pin 97 between the lever 87 of the runner 82 and the pivot arm 99. The first spring 101 presses the lever 87 and thus the runner 82 in the direction of the shaft wall 84. In addition, a second spring 102 in the form of a helical spring is arranged around the pin 97 between the pivot arm 99 and the cap 100 of the pin 97. The second spring 102 presses the cap 100 of the pin 97 and thus the lever 87 and the runner 82 away from the shaft wall 84. The first spring 101 and the second spring 102 thus form a first spring arrangement 103 of the connection 81.

The pivot arm 99 having the through-opening 98 is pivotable about a pivot axle 104 which extends in parallel with the through opening 98 and thus with the pin 97. The pivot arm 99 can thus, to a limited extent, execute a pivot movement along a circular path about the aforementioned pivot axle 104 and thus along the shaft wall 84. The possible movement of the pivot arm 99 thus has a horizontal component in addition to a vertical component. When the pivot arm 99 is pivoted, the through-opening 98 and thus the pin 97 are also pivoted. The lever 87 of the runner 82 is also pivoted relative to the pivot axle 104 and thus relative to the coupling element 44 by means of the pin 97. When the pivot arm 99 is pivoted about the pivot axle 104, the runner 82 thus executes a second relative movement with respect to the coupling element 44, which second relative movement, as described, has a horizontal component.

Figure 7:
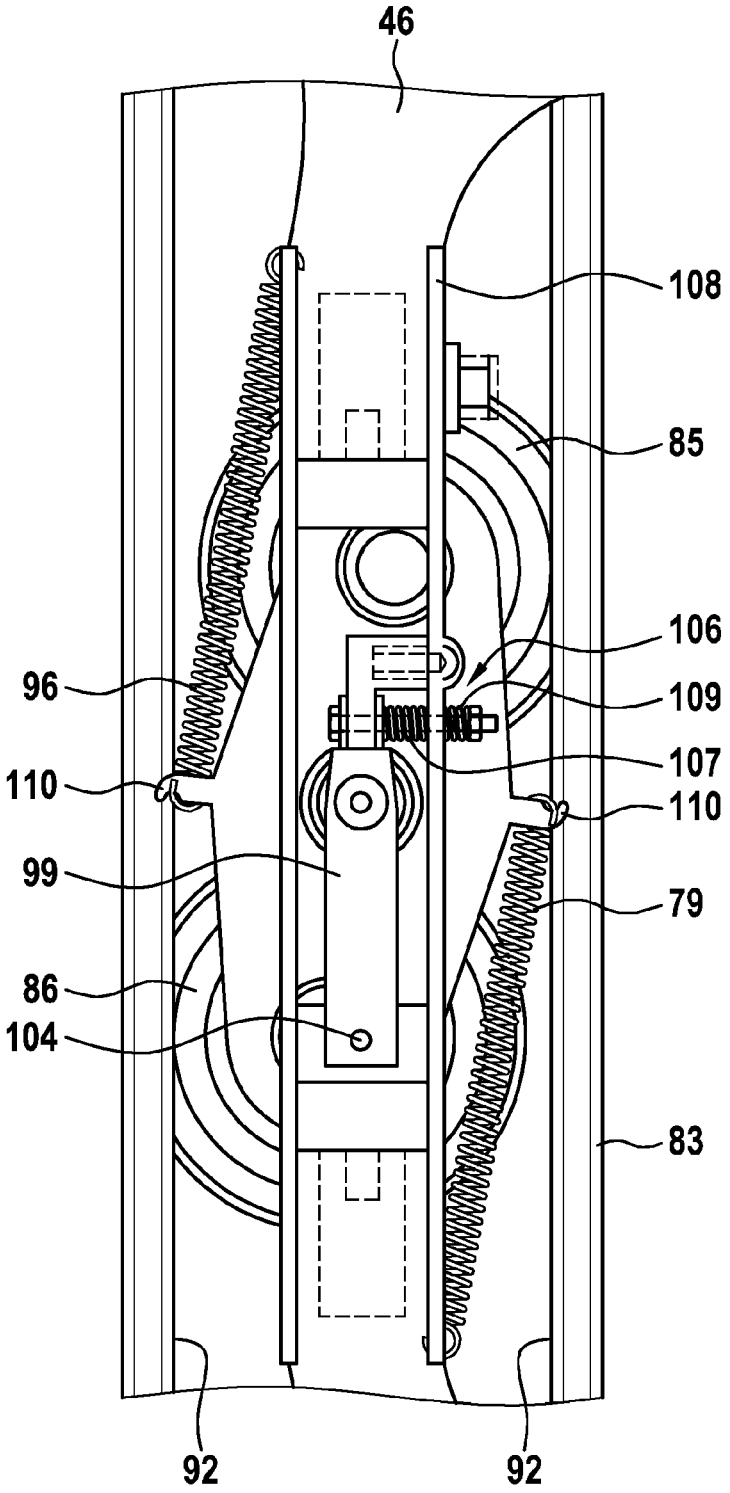
FIG. 7 is a view of a runner in a guide of the guide system from the direction of the coupling element.

A second spring arrangement 106, which is only shown in FIG. 7, acts on the pivot arm 99. The spring arrangement 106 has a third spring 107 which is arranged between the pivot arm 99 and a vertically extending component 108 of the coupling element 44 such that the spring presses the pivot arm 99 to the left in FIG. 7. The spring arrangement 106 also has a fourth spring 109 which is arranged on the side of the component 108 of the coupling element 44 facing away from the pivot arm 99 such that the spring presses the pivot arm 99 to the right in FIG. 7.

The third spring arrangement 95 is also clearly visible in FIG. 7. The upper, fifth spring 96 and the lower, sixth spring 79 are tensioned between an outwardly projecting hook 110 of the lever 87 and the perpendicular component 108 of the coupling element 44 such that the guide rollers 85, 86 are pressed against the inner faces 92 of the side cheeks 91 of the C-rail 83.

Finally, it must be noted that terms such as "having," "comprising," etc. do not preclude other elements or steps and terms such as "a" or "an" do not preclude a plurality. It must further be noted that features or steps which have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system comprising:

an elevator car movable in an elevator shaft;

a suspension means extending in the elevator shaft;

a drive machine associated with the suspension means;

a controllable coupling device arranged on the elevator car;

wherein the suspension means is attached to a coupling element adapted to couple to and uncouple from the controllable coupling device to respectively establish and release a drive connection between the elevator car and the suspension means, and when the drive connection is established the coupled elevator car is movable in the elevator shaft by the suspension means driven by the drive machine; and a guide system guiding the coupling element during movement of the elevator car, the guide system having a guide that is stationary relative to the elevator shaft and a runner connected to the coupling element via a connection, the runner being guided along the guide by the guide, and wherein the connection between the coupling element and the runner enables relative movement between the runner and the coupling element.

2. The elevator system according to claim 1 wherein the guide extends along a shaft wall of the elevator shaft and the relative movement between the runner and the coupling element includes a first relative movement in a first direction toward and away from the shaft wall.

3. The elevator system according to claim 2 wherein the connection between the coupling element and the runner includes a pin coupled to the runner and arranged in a recess in the coupling element, the pin being movable in the first direction toward and away from the shaft wall.

4. The elevator system according to claim 2 wherein the connection has a first spring arrangement adapted and arranged to apply a force to the runner in the first direction.

5. The elevator system according to claim 2 wherein the relative movement between the runner and the coupling element includes a second relative movement in a second direction along the shaft wall and having at least one horizontal component.

6. The elevator system according to claim 5 wherein the guide guides the runner in the first direction and in the second direction.

7. The elevator system according to claim 5 wherein the connection has a spring arrangement adapted and arranged to apply a force to the runner in the second direction.

8. The elevator system according to claim 2 wherein the connection between the coupling element and the runner includes a pin coupled to the runner and arranged in a recess in the coupling element, the pin being movable in the first direction toward the shaft wall and away from the shaft wall, and wherein the recess is arranged on a pivot arm of the coupling element, the pivot arm being pivotable along the shaft wall.

9. The elevator system according to claim 1 wherein the guide has a side cheek and the runner has a guide roller, the guide roller being guided on an inner face of the side cheek of the guide.

10. The elevator system according to claim 9 wherein the side cheek is a first side cheek and the guide has an opposite second side cheek, wherein the guide roller is a first guide roller and the runner has a second guide roller, the first guide roller being guided on the inner face of the first side cheek and the second guide roller being guided on an inner face of the second side cheek.

11. The elevator system according to claim 10 wherein the first guide roller is mounted on a first roller axle and the second guide roller is mounted on a second roller axle, the first and second roller axles being arranged on a lever of the runner that is pivotable about a lever axle of the runner.

12. The elevator system according to claim 11 wherein the lever axle of the runner is at least partially formed by a pin of the connection between the coupling element and the runner.

13. The elevator system according to claim 11 wherein the runner has a spring arrangement adapted and arranged to press the first and second guide rollers against the inner faces of the first and second side cheeks of the guide.

14. The elevator system according to claim 10 wherein the inner faces of the first and second side cheeks of the guide each have a concave contour and the first and second guide rollers of the runner have a corresponding convex profile.

15. A guide system for an elevator system, the elevator system having an elevator car movable in an elevator shaft, a suspension means extending in the elevator shaft, a drive machine associated with the suspension means, a controllable coupling device arranged on the elevator car, wherein the suspension means is attached to a coupling element adapted to couple to and uncouple from the controllable coupling device to respectively establish and release a drive connection between the elevator car and the suspension means, and when the drive connection is established, the coupled elevator car is movable in the elevator shaft by the suspension means driven by the drive machine, the guide system comprising:

a guide that is stationary relative to the elevator shaft;

a runner connected to the coupling element via a connection, the runner being guided along the guide, and wherein the connection between the coupling element and the runner enables relative movement between the runner and the coupling element; and wherein the guide system guides the coupling element during movement of the elevator car.

16. The guide system according to claim 15 wherein the guide extends along a shaft wall of the elevator shaft, wherein the relative movement between the runner and the coupling element includes a first relative movement in a first direction toward and away from the shaft wall, wherein the relative movement between the runner and the coupling element includes a second relative movement in a second direction along the shaft wall and having at least one horizontal component, and wherein the guide guides the runner in the first direction and in the second direction.

17. The guide system according to claim 16 wherein the connection between the coupling element and the runner includes a pin coupled to the runner and arranged in a recess in the coupling element, the pin being movable in the first direction toward and away from the shaft wall.

18. The guide system according to claim 16 wherein the connection has a first spring arrangement adapted and arranged to apply a force to the runner in the first direction.

19. The guide system according to claim 18 wherein the connection has a second spring arrangement adapted and arranged to apply a force to the runner in the second direction.

20. The guide system according to claim 15 wherein the guide has a first side cheek and an opposite second side cheek, wherein the runner has a first guide roller and a second guide roller, the first guide roller being guided on an inner face of the first side cheek and the second guide roller being guided on an inner face of the second side cheek.

21. The guide system according to claim 20 wherein the first guide roller is mounted on a first roller axle and the second guide roller is mounted on a second roller axle, the first and second roller axles being arranged on a lever of the runner that is pivotable about a lever axle of the runner.

22. The guide system according to claim 21 wherein the lever axle of the runner is at least partially formed by a pin of the connection between the coupling element and the runner.

23. The guide system according to claim 21 wherein the runner has a spring arrangement adapted and arranged to press the first and second guide rollers against the inner faces of the first and second side cheeks of the guide.

24. The guide system according to claim 20 wherein the inner faces of the first and second side cheeks of the guide each have a concave contour and the first and second guide rollers of the runner have a corresponding convex profile.

* * * * *